US006439734B1

(12) United States Patent
Lo

(10) Patent No.: US 6,439,734 B1
(45) Date of Patent: Aug. 27, 2002

(54) PEN LIGHT

(76) Inventor: Tien-Lin Lo, No.27, Lane 452, Chung Hsing Road, Pei Yu Village, Kuan Yin Hsiang, Tao Yuan Hsien (TW)

( * ) Notice: Subject to any disclaimer, the term of this patent is extended or adjusted under 35 U.S.C. 154(b) by 46 days.

(21) Appl. No.: 09/709,496

(22) Filed: Nov. 13, 2000

(51) Int. Cl.[7] ..... B43K 29/10

(52) U.S. Cl. ..... 362/118; 362/259; 362/579; 401/195

(58) Field of Search ..... 362/118, 259, 362/579; 401/195, 192

(56) References Cited

U.S. PATENT DOCUMENTS 2,979,602 A * 4/1961 Barnett ..... 362/118

6,099,185 A * 8/2000 Huang et al. ..... 362/118

* cited by examiner

*Primary Examiner*—Stephen Husar
(74) *Attorney, Agent, or Firm*—Rabin & Berdo, P.C.

(57) ABSTRACT

A pen light includes a barrel and a cap attached to the barrel, and cartridge being arranged within the barrel. The barrel is made from transparent material and is provided with connecting portions at both ends thereof for engagement with the cap. A lighting assembly is arranged in the cap and includes a lighting device being arranged within the cap and which is powered by a battery disposed within the cap. A switch is arranged on the cap for controlling On/Off of the lighting device, wherein the lighting device is arranged to an end of the cap. The cap can be used individually as a flashlight or together with the barrel thereby providing aesthetic appearance of the barrel.

6 Claims, 6 Drawing Sheets

PEN LIGHT

FIELD OF THE INVENTION

The present invention relates to a flashlight, and more particularly to a pen light in which a light device is incorporated in a cap thereof. The cap can be used individually as a flashlight. In addition, when the light device is lit, the barrel reflects the light such that the light beam can be directed to the intended direction no matter the cap is disposed on tip or tail.

DESCRIPTION OF THE PRIOR ART

As shown in FIG. 6, a conventional pen light generally includes a cartridge (b) disposed in. a barrel (a). A lighting device (c) is arranged in adjacent to the cartridge (b). The On/Off of the lighting device (c) as well as the extension/withdrawal of a tip of the cartridge (b) are both controlled by a push-button device (d) located in a rear end of the barrel (a). In an alternative, the barrel (a) is provided with a helical retracting device to withdraw the tip of the cartridge (b) into the barrel (a).

The conventional pen light can be concluded with the following defects.

1. The push-button has a complicated configuration which no doubt increases the manufacturing cost. Moreover, it takes time to assemble them.

2. It does not include a cap. As a result, it needs an additional retracting mechanism to withdraw the tip of the cartridge into the barrel. Again, the retracting mechanism increases the cost.

3. The retracting mechanism has a comparable complicated configuration. It generally has an outer diameter of 7 mm. When the thickness of the barrel is taken into account, the overall outer diameter will reach 13 mm. This is too large for a comfortable grip.

4. For those pens without retracting mechanism, a cap can be purchased to protect the tip of the cartridge. However, once the tip of the cartridge is closed by the cap, the intended purpose of the pen light is impaired. In addition, it would be difficult to perceive that On/Off of the pen light when the tip of the cartridge is enclosed. This leads unwanted exhaustion of a battery used to power the light device.

5. The conventional pen light has only one intended usage.

6. The energy loss is too high as the light path from the lighting device to an end is too long. As a result, a performance thereof is impaired.

7. The conventional pen light does not include a test switch which the customer can test the pen light. As a result, it would be unlikely that the customer can be attracted by the inherited functions of the pen light.

SUMMARY OF THE INVENTION

It is an objective of this invention to provide a pen light in which a lighting device is disposed in a cap thereof. The cap can be used individually or together with a barrel of a pen to serve as a lighting instrument.

It is still an objective of this invention to provide a pen light in which the barrel has a comparable small outer diameter thereby providing a user-friendly usage.

In order to achieve the objectives set forth, a pen light in accordance with the present invention includes a barrel and a cap attached to the barrel, and cartridge being arranged within the barrel. The barrel is made from transparent material and is provided with connecting portions at both ends thereof for engagement with the cap. A lighting assembly is arranged in the cap and includes a lighting device being arranged within the cap and which is powered by a battery disposed within the cap. A switch is arranged on the cap for controlling On/Off of the lighting device, wherein the lighting device is arranged to an end of the cap. The cap can be used individually as a flashlight or together with the barrel thereby providing gorgeous appearance of the barrel. A lens is arranged adjacent to the lighting device to increase the aesthetic appearance.

According to one aspect of the present invention, wherein the lighting means includes a printed circuit board on which an LED is mounted. The switch is electrically mounted on the printed circuit board for controlling the LED. The printed circuit board is provided with first and second switching junctions at one side, while another side of the printed circuit board is provided with a standard circuitry and a test circuitry. A pushing button is arranged to the switching junctions for selectively triggering the first or second switching junctions.

BRIEF DESCRIPTION OF THE DRAWINGS

Other objects and advantages of the present invention will become apparent from the following detailed description of the preferred embodiments thereof taken in conjunction with the accompanying drawings wherein.

DETAILED DESCRIPTION OF PREFERRED EMBODIMENT

Figure 1:
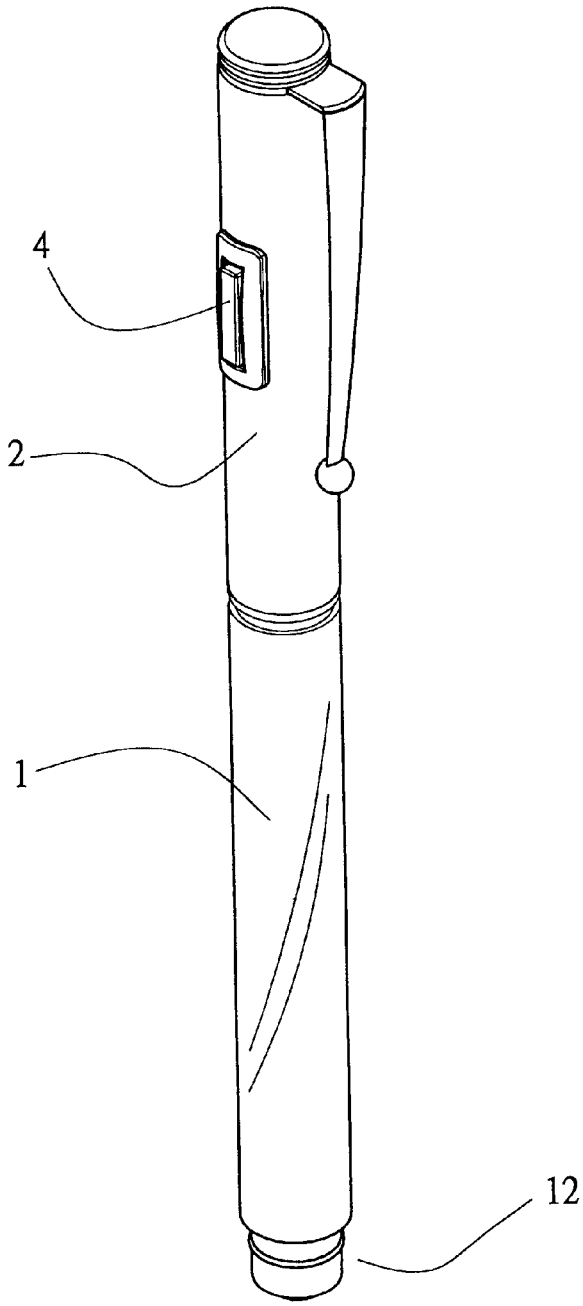
FIG. 1 is an assembled view of a pen light in accordance with the present invention.
Figure 2:
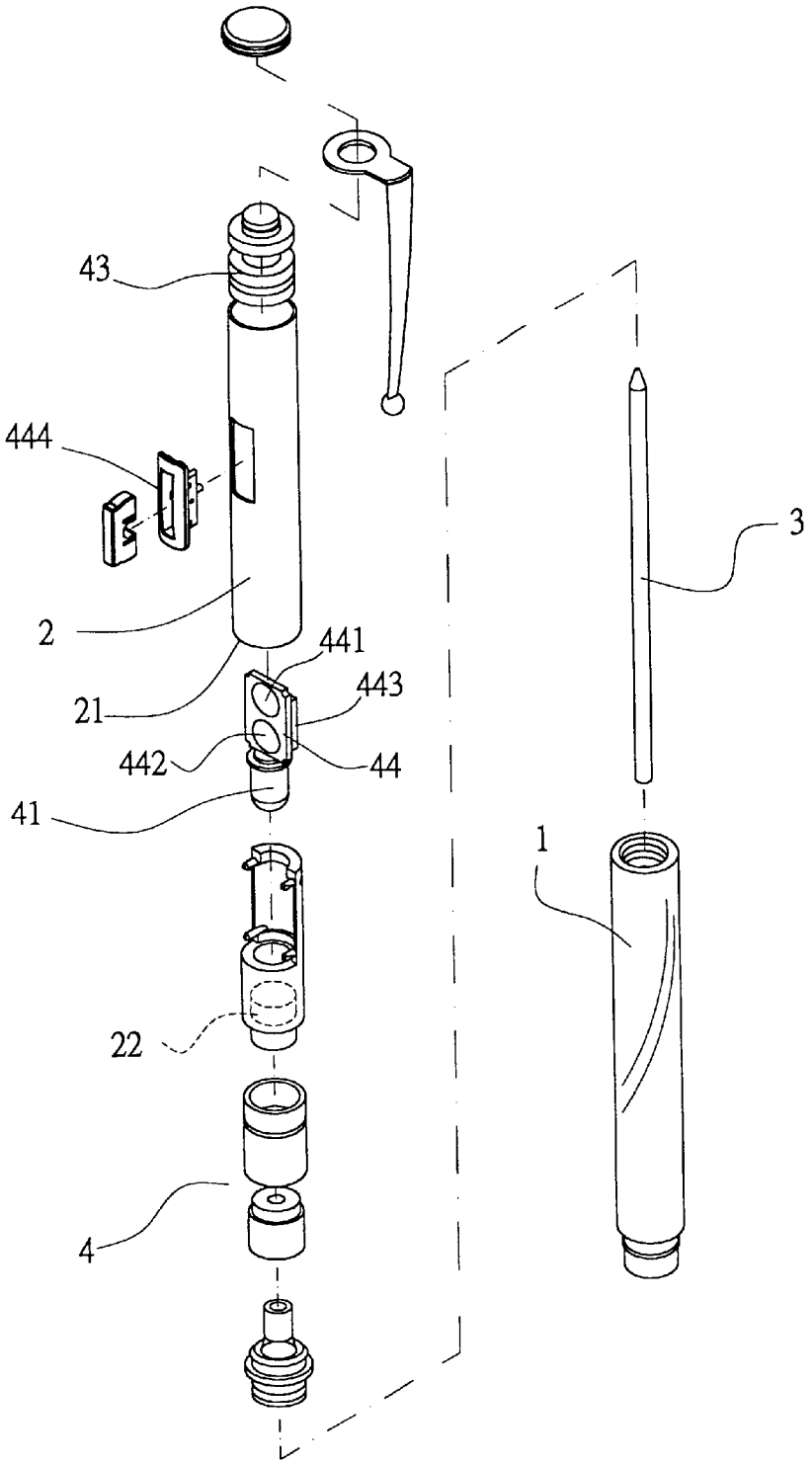
FIG. 2 is an exploded view of FIG. 1.

Referring to FIGS. 1 and 2, a pen light in accordance with the present invention generally includes a barrel 1 and a cap 2 capable of attaching to the barrel 1. The barrel 1 is provided with a cartridge 3 for writing.

The barrel 1 is made from transparent material, such as the transparent plastic material. The barrel 1 is provided with connecting portions 11, 12 at both ends thereof for engagement with the cap 2.

A lighting assembly 4 is arranged within the cap 2 and includes a lighting device 41 and which is powered by a battery 43 disposed within the cap 2. A switch 42 is arranged on the cap 2 for controlling On/Off of the lighting device 41. The lighting device 41 is arranged to an end 21 of the cap2 and which is adjacent to the barrel 1. The cap 2 is further provided with a convex lens 22 adjacent to the lighting device 41. By this arrangement, a light beam from the lighting device 41 will effectively shine through an inner wall of the barrel 1, thereby increasing an aesthetic effect of the barrel 1.

Figures 3, 3A:
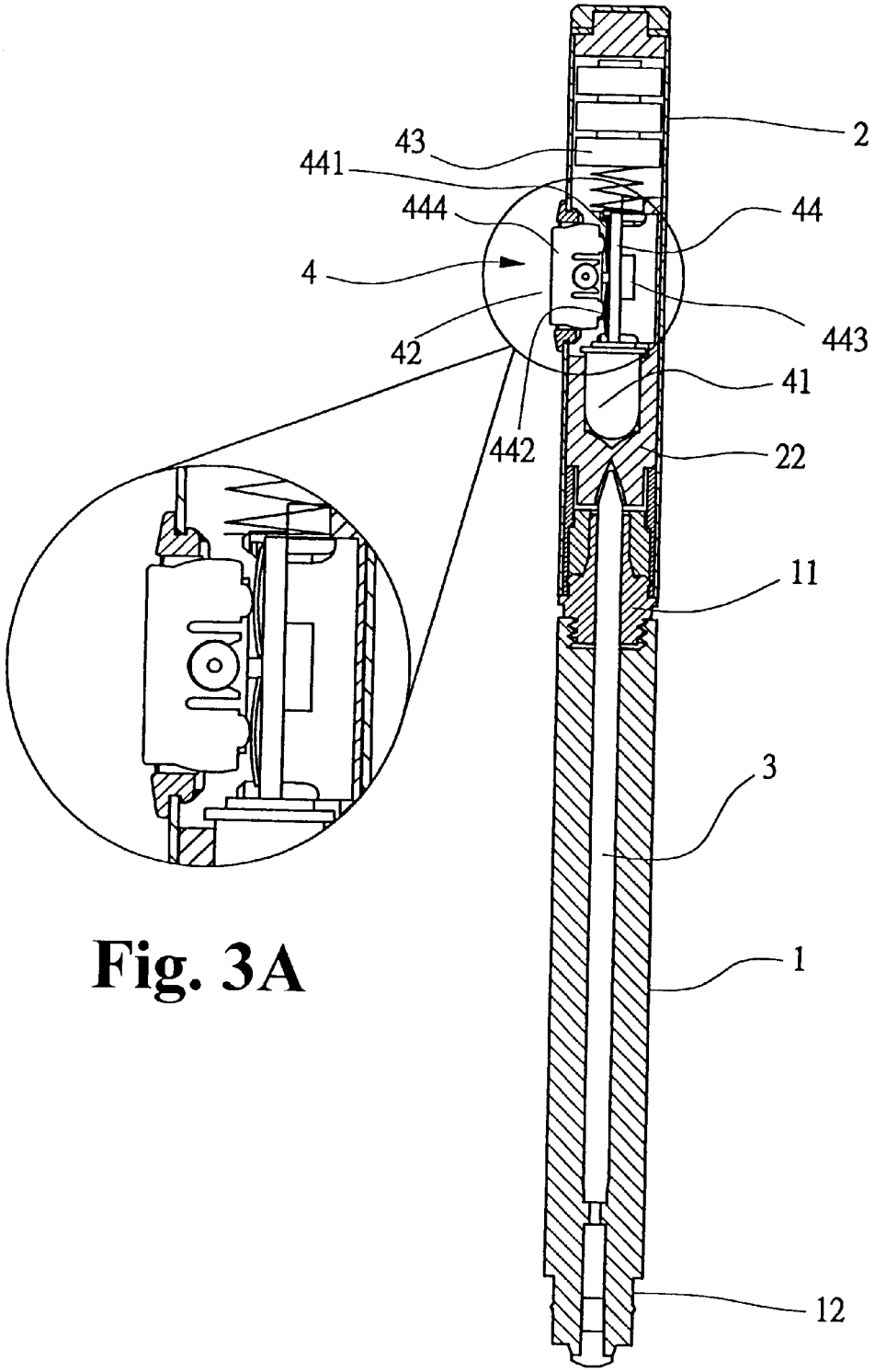
FIG. 3 is a cross sectional view taken along a longitudinal line of the pen light thereof.

Referring to FIG. 3, the lighting assembly 4 includes a printed circuit board 44 on which an LED 41 is mounted. The switch 42 is electrically connected on the printed circuit board 44 for controlling the On/Off of the LED 41. The printed circuit board 44 is provided with first and second switching junctions 441, 442 at one side, while another side of the printed circuit board 44 is provided with a standard circuitry and a test circuitry. In the preferred embodiment, the standard and test circuitry are integrated in an IC chip 443. A pushing button 444 is arranged to the switching junctions 441, 442 for selectively triggering the first or second switching junctions 441, 442.

Figure 4:
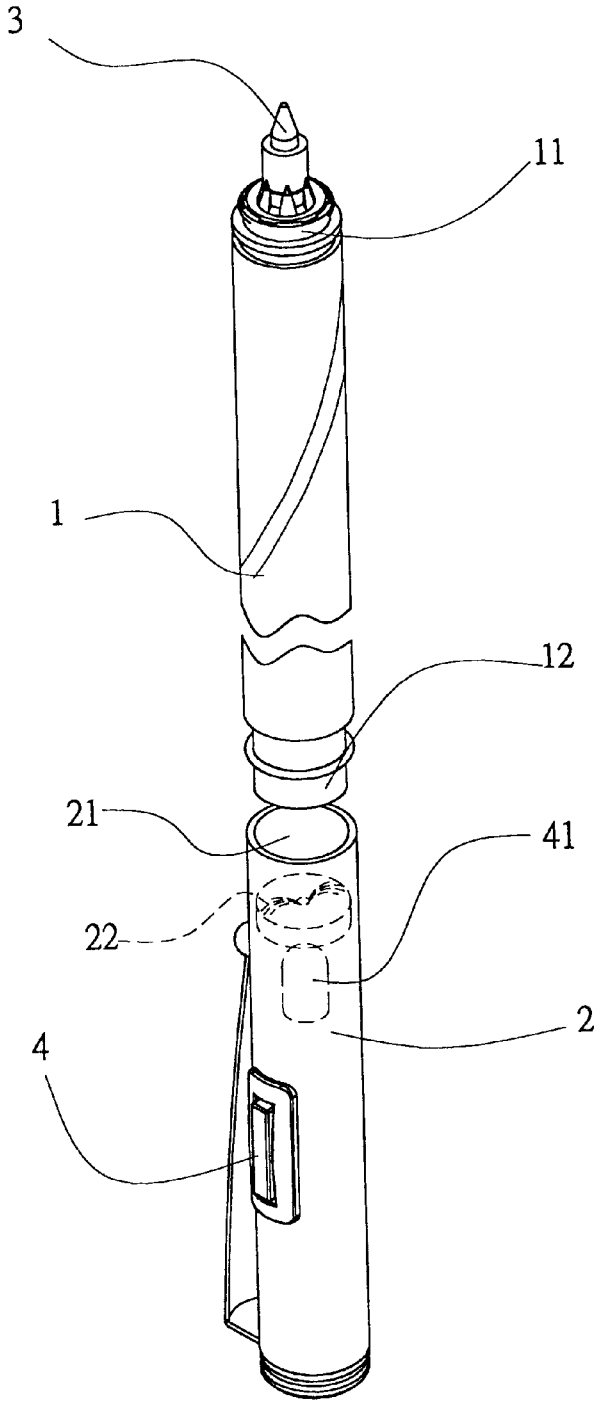
FIG. 4 is a perspective view showing a cap is attached to a tail of a barrel of the pen light.
Figure 5:
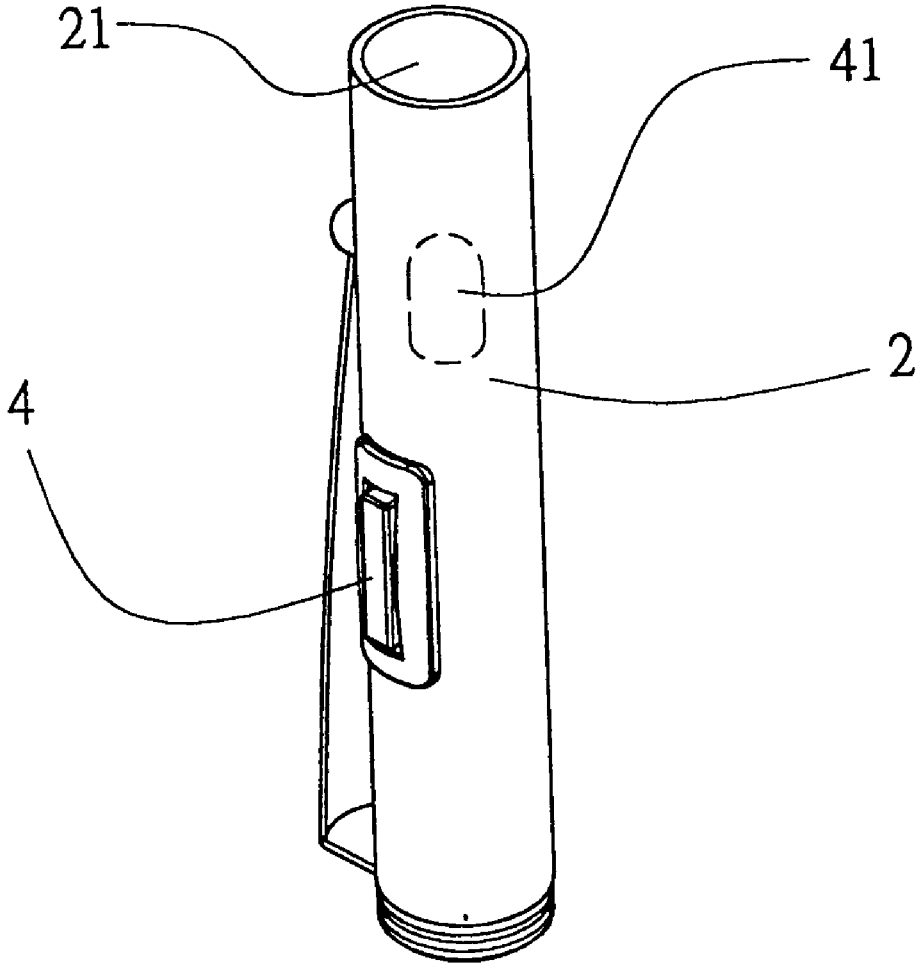
FIG. 5 is a perspective view of the cap.
Figure 6:
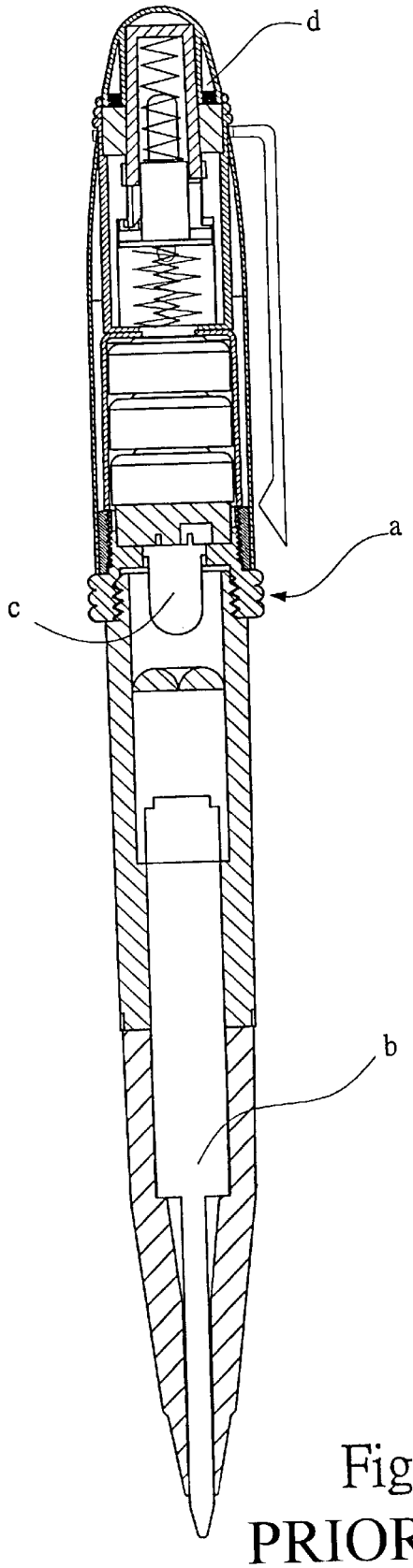
Fig.6 PRIOR ART
FIG. 6 is a cross sectional view of a conventional pen light.

According to the present invention, since the cap 2 can be completely separated from the barrel 1 and the lighting assembly 4 is arranged within the cap 2, the cap 2 can be used individually as a flashlight, such as shown in FIG. 4. In addition, the light beam from the lighting device 41 is projected to the end 21 which is in engagement with the barrel 1. As the barrel 1 is made from transparent plastic material, no matter the cap 2 is attached to a front end 11 or rear end 12 of the barrel 1, as long as the lighting device 41 of the lighting assembly 4 is switched on, the barrel 1 can be splendidly shined through thereby providing aesthetic appearance.

In addition, the lighting assembly 4 is provided with a test circuitry, the lighting device 41 can be used as a temporary light, i.e. the lighting device 41 will be kept on as long as the pushing button 444 is depressed, while the lighting device 41 will go off once the pushing button 444 is released. This is specially suitable for testing the function and aesthetic appearance of the pen light. Specially, when the pen light is put on the shelf and completely covered by a transparent film, the standard circuit can be triggered on firstly. Then the customer can easily test the effect by pressing down the pushing button to check the effect. Accordingly, the customer can be readily attracted and thereby increasing the sales volume.

In another embodiment of the invention, the convex lens 22 adjacent to the lighting device 41, as shown in FIGS. 2 and 4, is replaced by a concave lens.

While specific illustrated embodiment has been shown and described, it will be appreciated by those skilled in the-art that various modifications, changes, and additions can be made to the invention without departing from the spirit and scope thereof as set forth in the following claims.

I claim:

1. A pen light including a barrel and a cap attached to said barrel, a cartridge being arranged within said barrel, characterized in that said barrel is made from transparent material, said barrel being provided with connecting portions at both ends thereof for engagement with said cap, lighting means arranged in said cap including a lighting device being arranged within said cap and which is powered by a battery disposed within said cap, a switch arranged on said cap for controlling on/off operation of said lighting device in one of a standard mode and a test mode, wherein said lighting device is arranged to an end of said cap.

2. A pen light as recited in claim 1, wherein said lighting means includes a printed circuit board on which an LED is mounted, said switch being electrically mounted on said printed circuit board for controlling said LED, said printed circuit board being provided with first and second switching junctions on one side, the other side of said printed circuit board being provided with standard circuitry configured to cause said LED to operate in said standard mode and test circuitry configured to cause said LED to operate in said test mode, a push button being arranged to said switching junctions for selectively triggering one of said first and second switching junctions, said first switching junction being configured to activate said standard circuitry when triggered and said second switching junction being configured to activate said test circuitry when triggered.

3. A pen light as recited in claim 2, wherein a concave lens is arranged adjacent to said lighting device.

4. A pen light as recited in claim 1, wherein said standard mode is one in which said lighting device is alternatively turned on and off by activation of said switch, and said test mode is one in which said lighting device remains turned on only as long as said switch is activated.

5. A pen light including a barrel and a cap attached to said barrel, a cartridge being arranged within said barrel, characterized in that said barrel is made from transparent material, said barrel being provided with connecting portions at both ends thereof for engagement with said cap, lighting means arranged in said cap including a lighting device being arranged within said cap and which is powered by a battery disposed within said cap, a switch arranged on said cap for controlling on/off operation of said lighting device, wherein said lighting device is arranged to an end of said cap, and wherein a convex lens is adjacent to said lighting device.

6. A pen light as recited in claim 2, wherein said standard circuitry and said test circuitry are included in an integrated circuit.

* * * * *